US008141538B2

(12) United States Patent
Yang

(10) Patent No.: US 8,141,538 B2
(45) Date of Patent: Mar. 27, 2012

(54) INTAKE DUCTING DEVICE FOR A CAR ENGINE

(76) Inventor: Chung-Yu Yang, Taipei (TW)

( * ) Notice: Subject to any disclaimer, the term of this patent is extended or adjusted under 35 U.S.C. 154(b) by 677 days.

(21) Appl. No.: 12/314,538

(22) Filed: Dec. 12, 2008

(65) Prior Publication Data

US 2010/0147242 A1 Jun. 17, 2010

(51) Int. Cl.
*F02B 31/00* (2006.01)
*F02B 31/04* (2006.01)

(52) U.S. Cl. ..... 123/308; 123/306; 123/184.21

(58) Field of Classification Search ..... 123/590, 123/308, 184.21
See application file for complete search history.

(56) References Cited

U.S. PATENT DOCUMENTS

| | | | | | |
|---|---|---|---|---|---|
| 2,216,846 | A * | 10/1940 | Lewis | 48/189.4 |
| 3,216,182 | A * | 11/1965 | Cochran et al. | 55/336 |
| 3,930,485 | A * | 1/1976 | Konomi | 123/590 |
| 4,384,563 | A * | 5/1983 | Siefer et al. | 123/593 |
| 4,466,741 | A * | 8/1984 | Kojima | 366/339 |
| 5,027,754 | A * | 7/1991 | Morone | 123/184.54 |
| 5,685,281 | A * | 11/1997 | Li | 123/590 |
| 5,916,134 | A * | 6/1999 | Yang et al. | 60/299 |
| 5,924,398 | A * | 7/1999 | Choi | 123/184.21 |
| 5,947,081 | A * | 9/1999 | Kim | 123/306 |
| 6,796,296 | B2 * | 9/2004 | Kim | 123/590 |
| 7,086,498 | B2 * | 8/2006 | Choi et al. | 181/270 |
| 7,104,251 | B2 * | 9/2006 | Kim | 123/306 |
| 7,131,514 | B2 * | 11/2006 | Choi et al. | 181/270 |
| 7,367,329 | B2 * | 5/2008 | Yamamoto | 123/590 |
| 7,464,691 | B2 * | 12/2008 | Conner | 123/306 |
| 7,513,271 | B2 * | 4/2009 | Bachmann et al. | 137/592 |
| 2008/0308261 | A1 * | 12/2008 | Aschermann et al. | 165/121 |

FOREIGN PATENT DOCUMENTS

| | | | |
|---|---|---|---|
| WO | WO 9405906 | A1 * | 3/1994 |
| WO | WO 2008023856 | A1 * | 2/2008 |

* cited by examiner

*Primary Examiner* — Noah Kamen
*Assistant Examiner* — Grant Moubry
(74) *Attorney, Agent, or Firm* — Bacon & Thomas, PLLC

(57) ABSTRACT

An intake ducting device for a car engine comprising at least a round sheet main body having on its outer edge a circular ring, the circular ring can be fixed in the inner surface of an intake tube and is provided inside of it with a plurality of airflow disturbing holes, the airflow disturbing holes are arrayed at least in two layers from the inner side to the center of the circular ring and are in the form of grids, each airflow disturbing hole has at least an airflow deflector having an tilting angle relative to the axis of the intake tube, when airflow from the car intake tube passes the main body, by the function of the airflow disturbing holes and the airflow deflectors respectively in the airflow disturbing holes, the airflow can be separated against concentration, thereby the intake tube can take in air uniformly.

5 Claims, 7 Drawing Sheets

INTAKE DUCTING DEVICE FOR A CAR ENGINE

BACKGROUND OF THE INVENTION

1. Field of the Invention

The present invention relates to an intake ducting device for a car engine, and especially to an air ducting device fixed in an intake tube, it is used for separating air flow against concentration when air flow in an air intake of a car passes the air ducting device.

2. Description of the Prior Art

For the purpose of helping an engine to get better air taking in effect, various vortex generators provided on the front ends of intake tubes have been developed in the markets for the purpose of making the air flow in the tubes on the front ends of the intake able to generate a vortex flowing in the type of whirling, such a vortex can render the air in a large amount flowing into the intake passes with high speed in type of whirling.

As shown in FIG. 1 depicting the structure of a vortex generator which is installed in a pipe line in front of an intake of an engine, the technical measure in construction of the vortex 20 generator is that, a round tube 90 with a larger diameter is provided with a central hollow pipe 91 with a smaller diameter, a plurality of curved blades 92 are provided between the round tube 90 and the central hollow pipe 91; thereby when air flows through the vortex generator, the central portion of the air passing the central hollow pipe 91 will generate a straight air flow, and the ambient air passing the curved blades 92 is divided into a plurality of volute airflows; the straight air flow and the volute air flows flowing separately are integrated into an air flow vortex after they leave the vortex generator.

As shown in FIG. 2, there is another vortex generator that can integrate and guide a plurality of volute air flows, structurally, the vortex generator has a round tube 90 provided therein with a central guiding post 93, and a plurality of curved blades 92 are provided between the round tube 90 and the central guiding post 93, the tailing end of the central guiding post 93 is conical, an end opening 94 is formed between the tailing ends of both the central guiding post 93 and the curved blades 92; thereby when air flows through the vortex generator, the air flow is divided to flow separately to the spaces among the curved blades 92 to form a plurality of volute air flows, and the volute air flows are primarily integrated by the function of the conical tailing end of the central guiding post 93.

In addition to the above stated two kinds of conventional vortex generators, other similar structures include: U.S. Pat. Nos. 5,113,838; 6,158,412 and 6,796,296 etc., whichever of the prior art is, the key point of designing is, to make air flow taken in be in the type of volute air flow; such mode of air intake might get the function of speeding up air intake, however it also has the defect of non uniform air intake.

Especially in this designing, gaps between every two neighboring blades are each in a flaring shape flaring outwards from the center of a vortex generator to show a state of gradually increasing the degree of flaring, that is, the gaps between every two neighboring blades become smaller and smaller in the direction away from the central point; hence when in taking in air, the wind resistance at a location near the center of a vortex generator is much larger than that far away from the center of a vortex generator, thereby air intake of the entire vortex generator is not uniform. If under such a non uniform air intake situation, a user adds air catalyst or some other combustion supporting material, for instance nitrogen oxide (N2O), at the intake end of an engine, this will render the catalyst or the combustion supporting material unable to uniformly diffuse. Moreover, by virtue that each blade of a conventional vortex generator has different curvature in extending outwards from the central point, they are more difficult for manufacturing.

SUMMARY OF THE INVENTION

The object of the present invention is to provide an air ducting device that can make a car engine have uniform air intake. In order to get the above object, the intake ducting device for a car engine of the present invention is comprised of at least a round sheet main body having on its outer edge a circular ring, the circular ring can be fixed in the inner surface of an intake tube and is provided inside of it with a plurality of airflow disturbing holes, the airflow disturbing holes are arrayed at least in two layers from the inner side to the center of the circular ring and are in the form of grids, each airflow disturbing hole has at least an airflow deflector having an tilting angle relative to the axis of the intake tube, when airflow from the car intake tube passes the main body, by the function of the airflow disturbing holes and the airflow deflectors respectively in the airflow disturbing holes, the airflow can be separated against concentration, thereby the intake tube can take in air uniformly.

In practice, the above stated airflow disturbing holes are arrayed inside the circular ring and can be arrayed circularly at least in two layers from the inner side to the center of the circular ring; the above stated airflow disturbing holes can also be arrayed inside the circular ring and can be arrayed in a helical shape rolled up from the inner side to the center of the circular ring.

With the airflow disturbing holes arrayed circularly or in a helical shape, the amount of part of them which are nearer to the center of the circular ring can be less than those farther away from the center of the circular ring; so that the bores and sizes of those airflow disturbing holes nearer to the center of the circular ring are generally same as those farther away from the center of the circular ring, and thereby there will be no problem of having larger wind resistance at the area nearer to the center of the circular ring, thereby the airflow can be separated against concentration, and the intake tube can take in air uniformly. Surely, the airflow disturbing holes can be arrayed inside the circular ring in a rectangular or multilateral shape; this can make most of the airflow disturbing holes have mutually proximate bores and sizes.

And more, in practice the mode above stated having the airflow disturbing holes arrayed circularly or in a helical shape, the airflow deflectors of the airflow disturbing holes can tilt toward an identical direction; or a part of the airflow deflectors of the airflow disturbing holes can tilt toward a direction, but other part of the airflow deflectors can tilt toward a contrary direction. In the former case, the purpose that the airflow deflectors of the airflow disturbing holes tilt toward an identical direction is to make uniform intake, but the object of leading the air intake to form volute air flows can also be achieved; while in the latter case, a part of the airflow deflectors of the airflow disturbing holes tilt toward a contrary direction, so that the airflow can be more uniformly diffused against concentration; the mode that the part of the airflow disturbing holes tilt toward a contrary direction can also be applied to the embodiment that the airflow disturbing holes arrayed inside the circular ring to form a rectangular or multilateral shape.

In addition to the above stated embodiments, those airflow disturbing holes arrayed in the form of grids can be provided among themselves with a plurality of air venting holes without airflow deflectors also for the purpose that the airflow can be separated against concentration.

Moreover, for the convenience of manufacturing, the air ducting device of the present invention can be formed by stacking a plurality of main bodies, each main body is provided on the outer edge of its circular ring with a connecting portion for stacking and fixing to a neighboring main body, in this way, the thickness of each main body can be thinner, in manufacturing, the main body can be made of normal plastics or composite material, thereby its material used is not limited, and this can reduce the volume of a die in production and elevate the production efficiency.

In comparison with the prior art, because the airflow disturbing holes of the present invention are arrayed at least in two layers from the inner side to the center of the circular ring and are in the form of grids, each airflow disturbing hole has at least an airflow deflector having an tilting angle relative to the axis of the intake tube, when airflow from the car intake tube passes a main body, by the function of the airflow disturbing hole and the airflow deflector in the airflow disturbing hole, the airflow can be separated against concentration, thereby the intake tube can take in air uniformly. Especially when air catalyst or some other combustion supporting material (for instance nitrogen oxide (N2O)) is added, the catalyst or the combustion supporting material can uniformly diffuse.

The present invention will be apparent after reading the detailed description of the preferred embodiment thereof in reference to the accompanying drawings.

DETAILED DESCRIPTION OF THE PREFERRED EMBODIMENT

Figure 1:
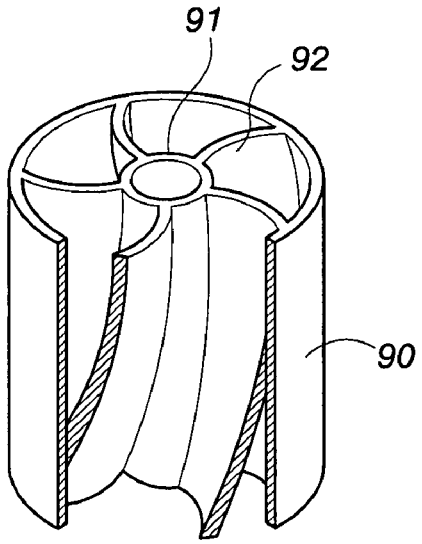
PRIOR ART FIG.1
FIG. 1 is a perspective view showing the structure of a conventional intake vortex generator for a car engine.
Figure 2:
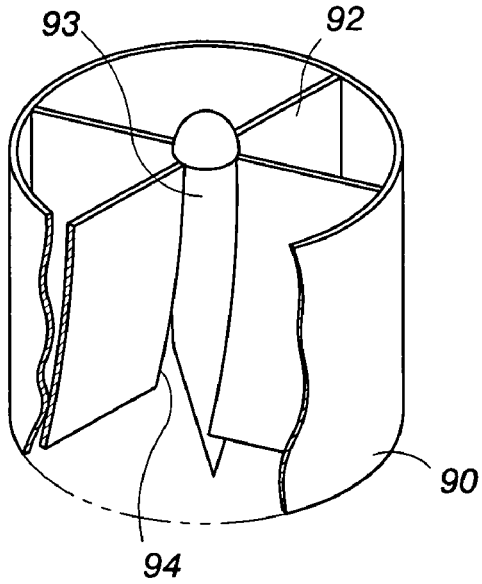
PRIOR ART FIG.2
FIG. 2 is a perspective view showing the structure of another conventional vortex generator.
Figure 3:
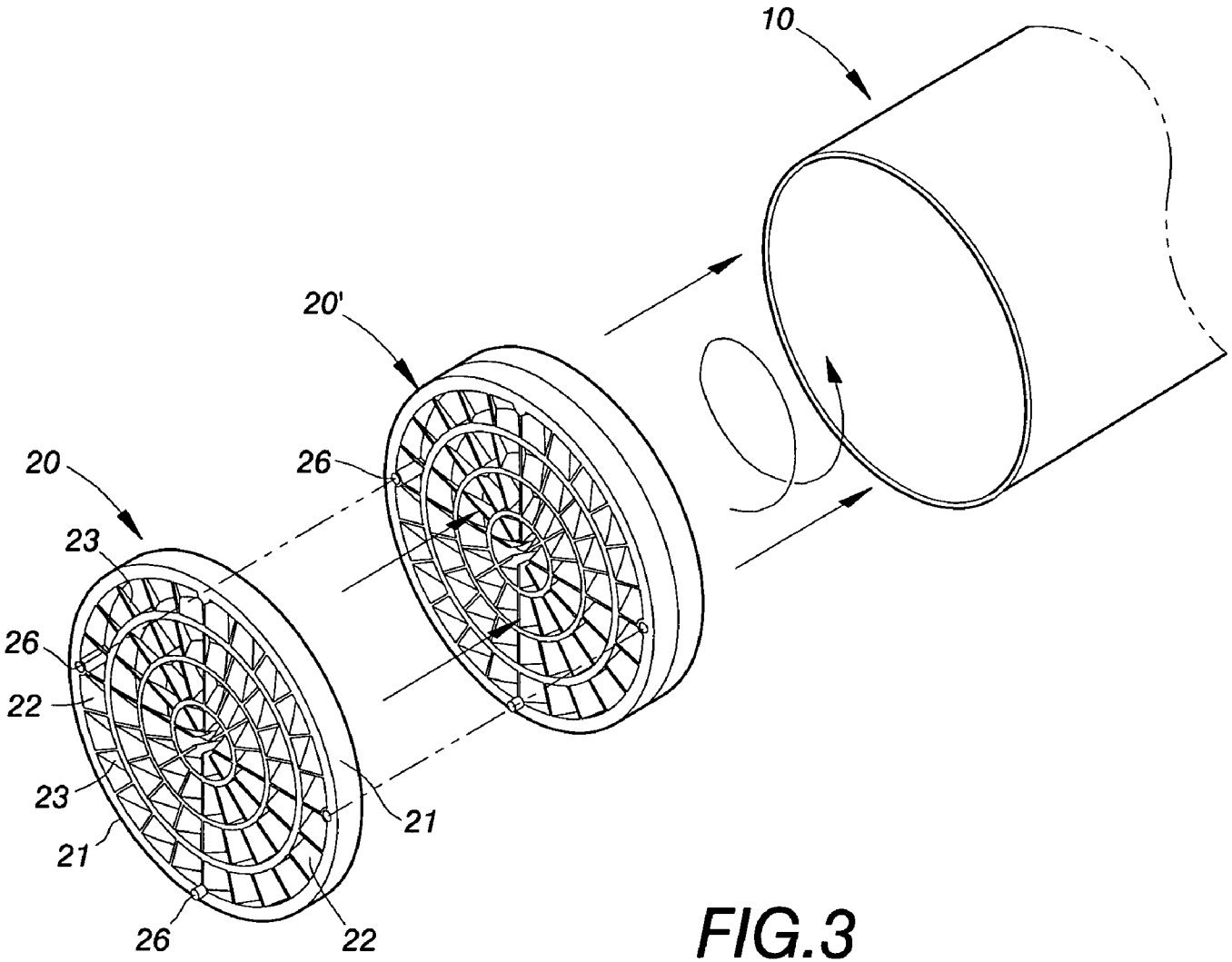
FIG. 3 is an anatomic perspective view showing mounting of a first embodiment of the present invention.
Figure 4:
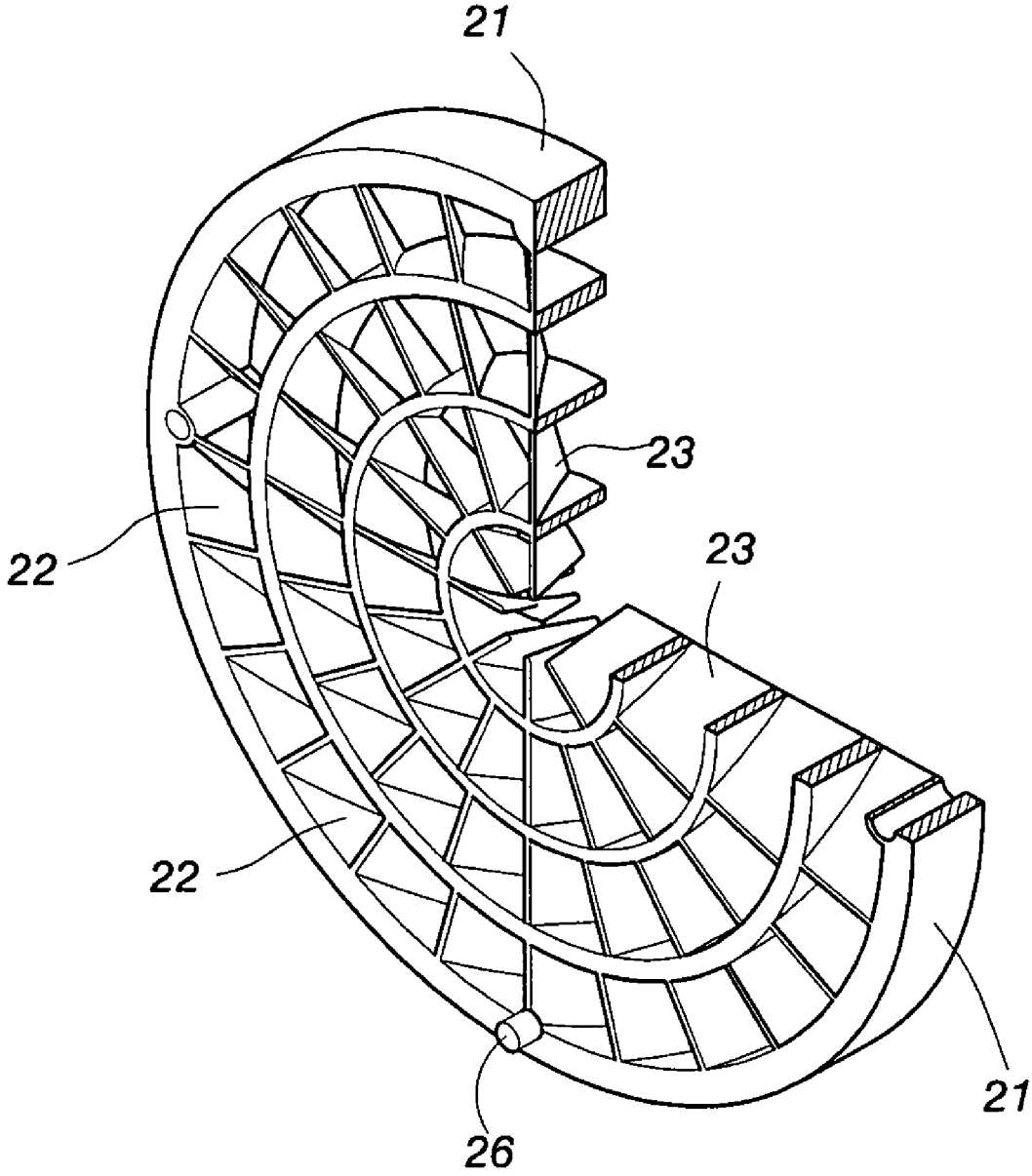
FIG. 4 is an exploded perspective view showing the structure of the first embodiment of the present invention.

Referring to an air intake ducting device for a car engine of the first embodiment of the present invention as shown in FIGS. 3, 4, wherein the intake ducting device includes at least a round sheet main body 20 having on its outer edge a circular ring 21, the circular ring 21 can be fixed in the inner surface of an intake tube 10 and is provided inside of it with a plurality of airflow disturbing holes 22, the airflow disturbing holes 22 are arrayed at least in two layers from the inner side to the center of the circular ring 21 and are in the form of grids, each airflow disturbing hole 22 has at least an airflow deflector 23 having an tilting angle relative to the axis (in the direction of air taking in) of the car intake tube 10, when airflow from the car intake tube 10 passes the main body 20, by the function of the airflow disturbing holes 22 and the airflow deflectors 23 respectively in the airflow disturbing holes 22, the airflow can be separated against concentration, thereby the intake tube 10 can take in air uniformly.

Figure 5:
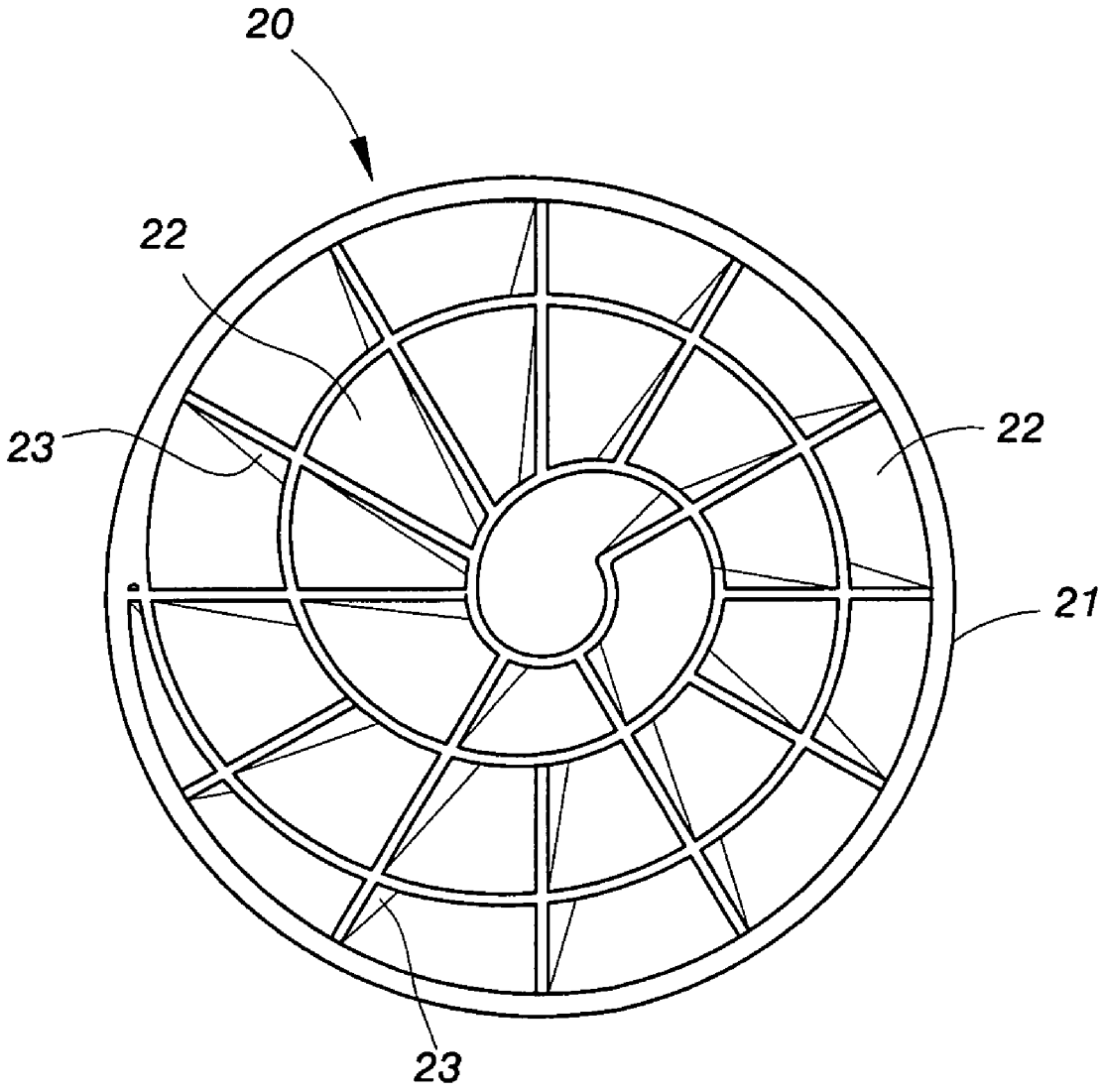
FIG. 5 is a plane view showing the structure of a second embodiment of the present invention.

In the drawings, the airflow disturbing holes 22 are arrayed inside the circular ring 21 and can be arrayed circularly at least in two layers from the inner side to the center of the circular ring 21; in practice, it can also be arranged as in the second embodiment of the present invention as shown in FIG. 5, the airflow disturbing holes 22 are arrayed inside the circular ring 21 and are arrayed in a helical shape rolled up from the inner side to the center of the circular ring 21.

In the two embodiments of the present invention as shown in FIGS. 3 to 5, with the airflow disturbing holes 22 arrayed circularly or in a helical shape, the amount of part of them which are nearer to the center of the circular ring can be less than those farther away from the center of the circular ring 21; so that the bores and sizes of those airflow disturbing holes nearer to the center are generally same as those farther away from the center, thereby there will be no problem of having larger wind resistance at the area nearer to the center of the circular ring 21, thereby the airflow can be separated against concentration, and the intake tube 10 can take in air uniformly.

Figure 6:
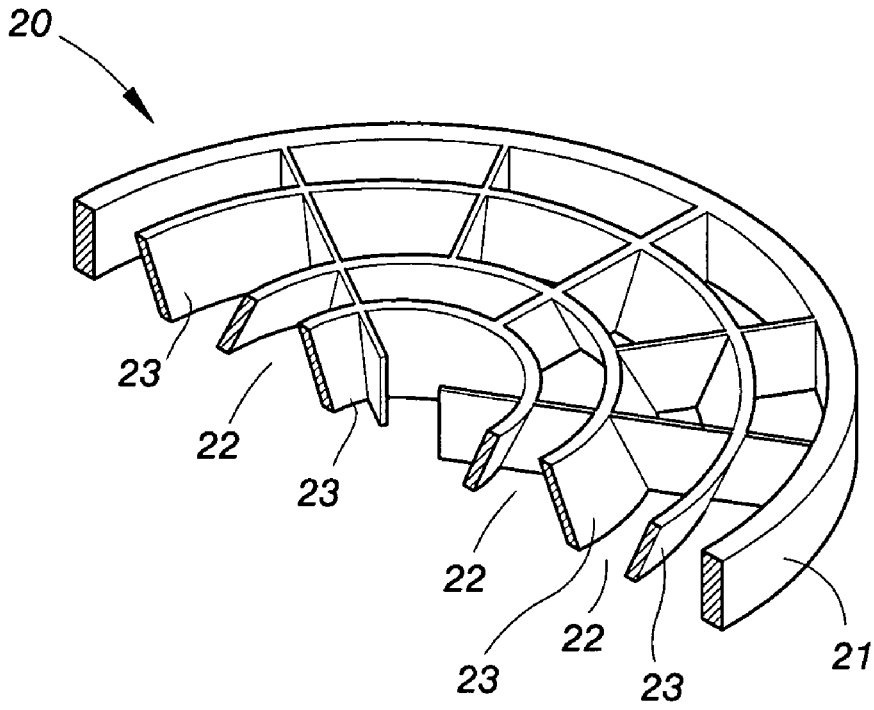
FIG. 6 is an exploded perspective view showing the structure of a third embodiment of the present invention.
Figure 7:
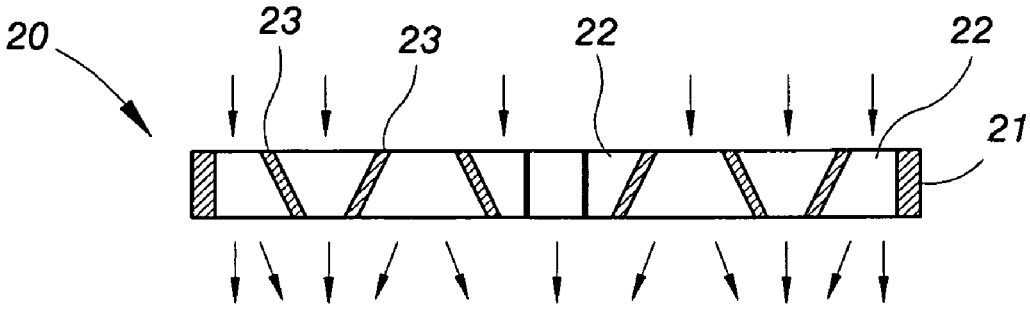
FIG. 7 is a sectional view of the third embodiment of the present invention.

And more, in practice the mode above stated having the airflow disturbing holes 22 arrayed circularly or in a helical shape, the airflow deflectors 23 of the airflow disturbing holes 22 can tilt toward an identical direction, or as the case of the third embodiment shown in FIGS. 6 and 7, a part of the airflow deflectors 23 of the airflow disturbing holes 22 can tilt toward a direction, but other part of the airflow deflectors 23 can tilt toward a contrary direction. In the former case (as shown in FIGS. 3 to 5), the purpose that the airflow deflectors 23 in the airflow disturbing holes 22 tilt toward an identical direction is to make uniform intake, but the object of leading the air intake to form volute air flows can also be achieved; while in the latter case (as shown in FIGS. 6 and 7), a part of the airflow deflectors 23 of the airflow disturbing holes 22 tilt toward a contrary direction, the airflow can be more uniformly diffused against concentration. Additionally, when air catalyst or some other combustion supporting material (for instance nitrogen oxide (N2O)) is added, the catalyst or the combustion supporting material can uniformly diffuse.

Figure 8:
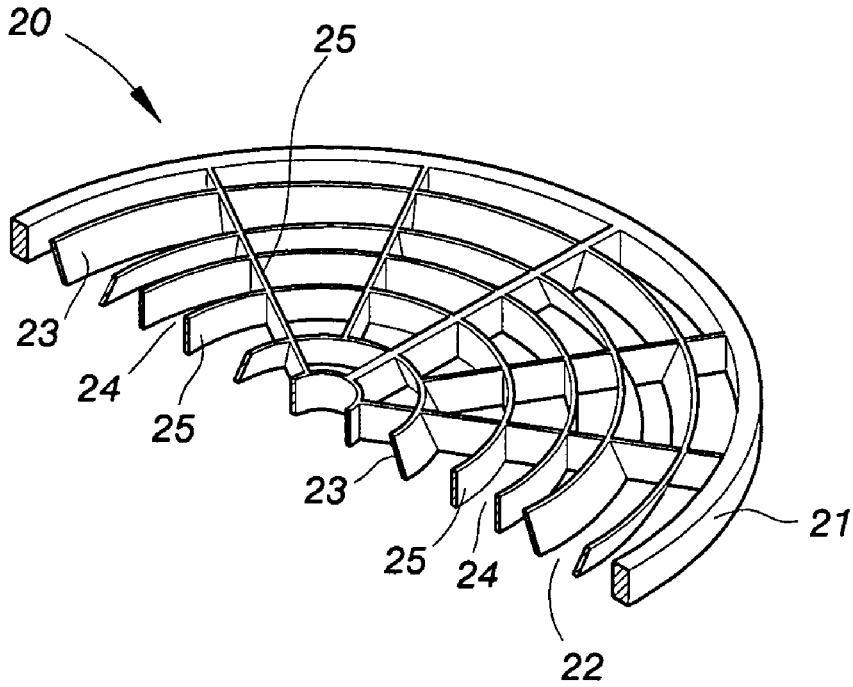
FIG. 8 is an exploded perspective view showing the structure of a fourth embodiment of the present invention.
Figure 9:
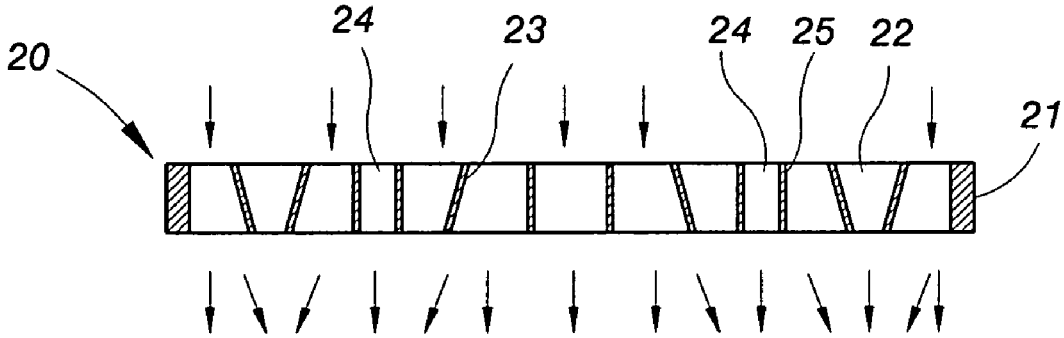
FIG. 9 is a sectional view of the fourth embodiment of the present invention showing separating of airflow.

As shown in FIGS. 8, 9 depicting a fourth embodiment of the present invention, those airflow disturbing holes 22 having the airflow deflectors 23 and arrayed in the form of grids can be provided among themselves with a plurality of air venting holes 24 which each has therearound partition plates 25 which are parallel to the axle direction of the intake tube 10 and have no tilting angle for the purpose of making the airflow be separated against concentration.

Moreover, as shown in FIG. 3, for the convenience of manufacturing, the air ducting device of the present invention can be formed by stacking a plurality of main bodies 20, each main body 20 is provided on the outer edge of its circular ring 21 with a connecting portion 26 for stacking and fixing to another main body 20', in this way, the thickness of each main body 20 can be thinner; in manufacturing, the main body 20 can be made of normal plastics or composite material, thereby its material used is not limited, and this can reduce the volume of a die in production and elevate the production efficiency.

Particularly, the main body 20 can be made of composite material containing air catalyst to increase the practicability of the entire air ducting device.

Figure 10:
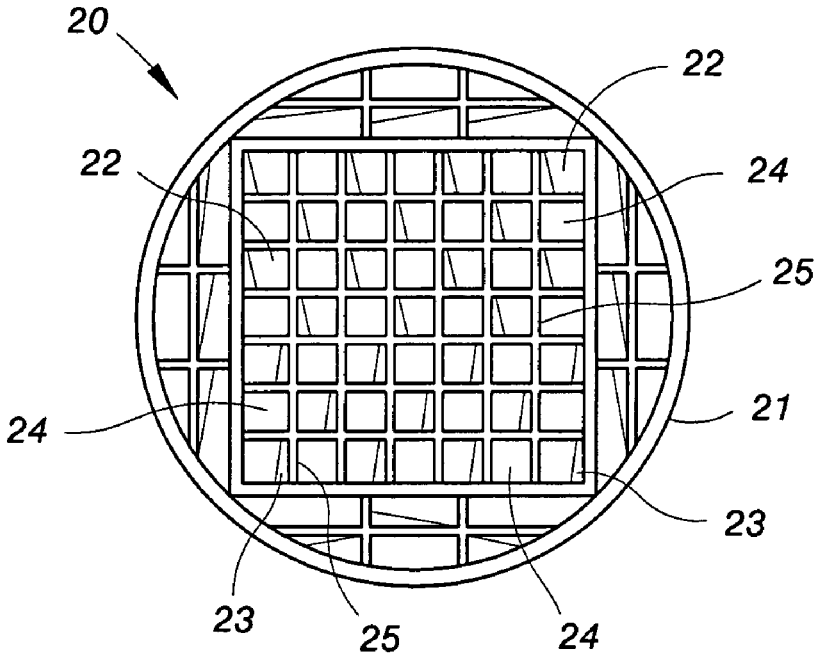
FIG. 10 is a plane view showing the mode of arraying of the airflow disturbing holes of a fifth embodiment of the present invention.
Figure 11:
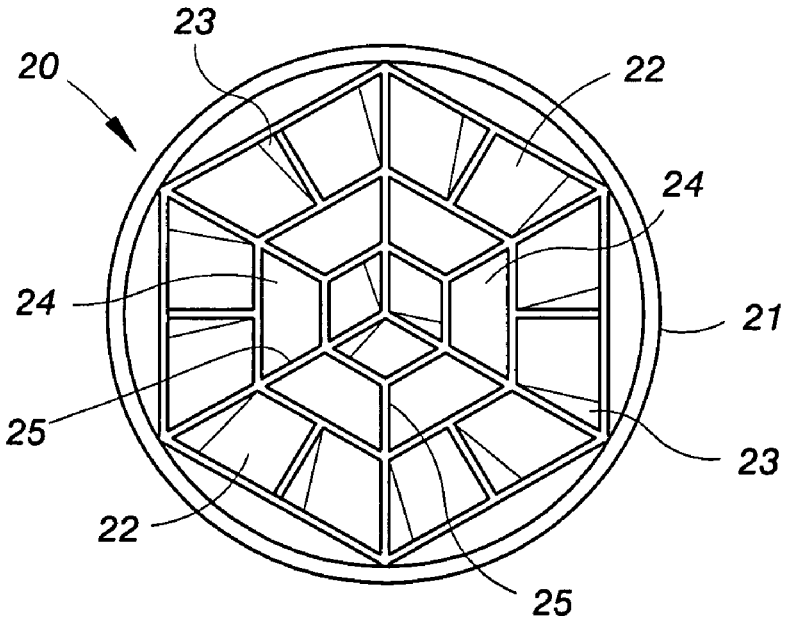
FIG. 11 is a plane view showing the mode of arraying of the airflow disturbing holes of a sixth embodiment of the present invention.

FIGS. 10, 11 respectively show a fifth and a sixth embodiment of the present invention, for the purpose of solving the problem of having larger wind resistance at the area nearer to the center of the circular ring 21 as stated for the prior art above, the embodiment of the present invention still have the circular ring 21 of the main body 20 provided inside of it with a plurality of airflow disturbing holes 22 which are arrayed in the form of grids, each airflow disturbing hole 22 has at least an airflow deflector 23 having an tilting angle relative to the axis of the car intake tube 10, the airflow disturbing holes 22 can be arrayed inside the circular ring 21 in a rectangular shape (FIG. 10) or a multilateral shape (FIG. 11), this can make most of the airflow disturbing holes 22 have mutually proximate bores and sizes. And in practice, the airflow disturbing holes 22 can be provided among themselves with a plurality of air venting holes 24 which each has therearound partition plates 25 which are parallel to the axle direction (in the direction of air taking in) of the car intake tube 10, and have no tilting angle for the purpose of making the airflow be separated against concentration. Surely, the fifth and the sixth embodiments can also have part of the airflow deflectors 23 of the airflow disturbing holes 22 tilt toward a contrary direction.

The embodiment given and the drawings shown are only for illustrating the preferred embodiments of the present invention, and not for giving any limitation to the scope of the present invention; it will be apparent to those skilled in this art that various modifications or changes such as in appearance, modeling, structure, installing and features without departing from the spirit of this invention shall also fall within the scope of the appended claims.

The invention claimed is:

1. An intake ducting device for a car engine comprising:

at least a round sheet main body having on its outer edge a circular ring, said circular ring is fixed in an inner surface of a car intake tube and is provided inside of it with a plurality of airflow disturbing holes, said airflow disturbing holes are arrayed at least in two layers from an inner side to a center of said circular ring and are in form of grids, each of said airflow disturbing holes has at least an airflow deflector having a tilting angle relative to an axis of said intake tube, when airflow from said car intake tube passes said main body, by function of said airflow disturbing holes and said airflow deflectors respectively in said airflow disturbing holes, said airflow is separated against concentration, thereby said car intake tube takes in air uniformly;

wherein said airflow disturbing holes are arrayed inside said circular ring and are arrayed circularly at least in two layers from said inner side to said center of said circular ring;

wherein a part of said airflow deflectors of said airflow disturbing holes tilt toward a direction, other part of said airflow deflectors tilt toward a contrary direction; and wherein amount of part of said airflow disturbing holes arrayed at least in two layers which are nearer to said center of said circular ring is less than amount of other part of said airflow disturbing holes farther away from said center of said circular ring.

2. The intake ducting device for a car engine as claimed in claim 1, wherein said airflow disturbing holes arrayed in said form of grids are provided among themselves with a plurality of air venting holes which each has therearound partition plates which are parallel to an axle direction of said intake tube.

3. An intake ducting device for a car engine comprising:

at least a round sheet main body having on its outer edge a circular ring, said circular ring is fixed in an inner surface of a car intake tube and is provided inside of it with a plurality of airflow disturbing holes, said airflow disturbing holes are arrayed at least in two layers from an inner side to a center of said circular ring and are in form of grids, each of said airflow disturbing holes has at least an airflow deflector having a tilting angle relative to an axis of said intake tube, when airflow from said car intake tube passes said main body, by function of said airflow disturbing holes and said airflow deflectors respectively in said airflow disturbing holes, said airflow is separated against concentration, thereby said car intake tube takes in air uniformly;

wherein said airflow disturbing holes arrayed inside said circular ring are arrayed in a helical shape; and wherein a part of said airflow deflectors of said airflow disturbing holes tilt toward a direction, other part of said airflow deflectors tilt toward a contrary direction.

4. The intake ducting device for a car engine as claimed in claim 3, wherein said airflow disturbing holes arrayed in said form of grids are provided among themselves with a plurality of air venting holes which each has therearound partition plates which are parallel to an axle direction of said intake tube.

5. An intake ducting device for a car engine comprising:

at least a round sheet main body having on its outer edge a circular ring, said circular ring is fixed in an inner surface of a car intake tube and is provided inside of it with a plurality of airflow disturbing holes, said airflow disturbing holes are arrayed at least in two layers from an inner side to a center of said circular ring and are in form of grids, each of said airflow disturbing holes has at least an airflow deflector having a tilting angle relative to an axis of said intake tube, when airflow from said car intake tube passes said main body, by function of said airflow disturbing holes and said airflow deflectors respectively in said airflow disturbing holes, said airflow is separated against concentration, thereby said car intake tube takes in air uniformly;

wherein said airflow disturbing holes are arrayed inside said circular ring in a multilateral shape; and wherein a part of said airflow deflectors of said airflow disturbing holes tilt toward a direction, other part of said airflow deflectors tilt toward a contrary direction.

* * * * *